US005835109A

United States Patent [19]

Uchida

[11] Patent Number: 5,835,109

[45] Date of Patent: Nov. 10, 1998

[54] INK JET APPARATUS WITH COLLECTIVELY CAPPED MULTICOLOR INK DISCHARGE OPENINGS

[75] Inventor: Haruo Uchida, Yokohama, Japan

[73] Assignee: Canon Kabushiki Kaisha, Tokyo, Japan

[21] Appl. No.: 798,933

[22] Filed: Feb. 11, 1997

Related U.S. Application Data

[63] Continuation of Ser. No. 247,851, May 23, 1994, abandoned.

[30] Foreign Application Priority Data

May 25, 1993 [JP] Japan ..... 5-122843

[51] Int. Cl.[6] ..... B41J 2/165

[52] U.S. Cl. ..... 347/24; 347/29; 347/30

[58] Field of Search ..... 347/24, 29, 30, 347/31, 32, 33, 43

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,492,969 | 1/1985 | Terasawa | 347/30 |
| 4,506,277 | 3/1985 | Terasawa | 347/24 |
| 4,510,510 | 4/1985 | Terasawa | 347/30 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,750,009 | 6/1988 | Yoshimura | 347/43 |
| 4,908,638 | 3/1990 | Albosta et al. | 347/43 |
| 5,086,305 | 2/1992 | Terasawa | 347/30 |
| 5,182,582 | 1/1993 | Okamura | 347/33 |
| 5,504,508 | 4/1996 | Hashimoto | 347/24 |

FOREIGN PATENT DOCUMENTS

| | | | |
|---|---|---|---|
| 0509687 | 10/1992 | European Pat. Off. . | |
| 3736916 | 5/1988 | Germany . | |
| 59-123670 | 7/1984 | Japan . | |
| 59-138461 | 8/1984 | Japan . | |
| 02-55147 | 2/1990 | Japan | 347/30 |

*Primary Examiner*—John E. Barlow, Jr.
*Attorney, Agent, or Firm*—Fitzpatrick, Cella, Harper & Scinto

[57] ABSTRACT

An ink jet apparatus has discharge openings for discharging yellow, cyan, magenta and black inks. Suction recovery in the apparatus is performed using a cap which caps all of the discharge openings collectively. A suction opening is located in the cap closer to the discharge openings for dark (e.g. black) ink than to the discharge openings for light (e.g. yellow) ink. When suction is applied to the cap, ink is drawn from all the discharge openings, and mixing of inks close to discharge openings for light-color inks is minimized.

33 Claims, 12 Drawing Sheets

INK JET APPARATUS WITH COLLECTIVELY CAPPED MULTICOLOR INK DISCHARGE OPENINGS

BACKGROUND OF THE INVENTION

This application is a continuation of application Ser. No. 08/247,851 filed May 23, 1994, now abandoned.

FIELD OF THE INVENTION

The present invention relates to an ink jet apparatus for discharging ink from a discharge opening, and more particularly to a recovery device for an ink jet apparatus for recovering or for maintaining a good ink-discharging condition.

RELATED BACKGROUND ART

An ink jet apparatus discharges ink to print or to record images, characters or the like on a recording member such as paper, a thin plastic film, textile or the like according to information signals. The ink jet apparatus can function as a printer, a copying machine, a facsimile or an output terminal of an electronic machine such as a work station, a computer, a word processor or the like. The ink jet apparatus can be applied easily to color and half-tone (gray-scale) printing.

In such ink jet apparatus, recovery means is usually provided to recover or to maintain a good ink-discharging condition, for example, to prevent ink discharge openings from being clogged by extraneous matter such as viscous ink, dust and the like. This recovery means is located at a certain position in the ink jet apparatus, for example, a home position of a carriage for carrying an ink jet head, which is in a range of the movement of the carriage, but out of an area where the ink jet head performs recording. The recovery means has a cap usually made of gas-impermeable elastic material for covering and closing tightly the discharge openings of the ink jet head from the atmosphere, and a suction pump connected to the cap through a suction tube for performing suction recovery by applying negative pressure to the discharge openings while capping by the cap.

As described in U.S. Pat. Nos. 4,492,969, 4,506,277, 4,510,510 and 5,086,305, a color ink jet apparatus has plural caps and/or plural suction tubes for the different colors of ink. This is mainly because, if only one cap is provided to cap all discharge openings of color ink, there is a possibility that different color inks mix with one another in the cap and the mixed ink adheres on a surface of the discharge openings or flows backward into the discharge openings to disturb the tone on a recording member.

On the other hand, plural caps lead to greater cost for the structure, for the mechanism and for the control system of the ink jet apparatus because the number of parts and the complexity of the operation of the apparatus cannot help increasing. Moreover, such an arrangement makes it to decrease the size of the apparatus.

SUMMARY OF THE INVENTION

The present invention has been developed in consideration of the aforesaid situation.

It is one object of the present invention to provide an improved ink jet apparatus and an improved recovery device for an ink jet apparatus which can overcome the problems described above.

It is another object of the present invention to provide an ink jet apparatus and a recovery device for an ink jet apparatus which can prevent deterioration of recording quality.

It is another object of the present invention to provide a color ink jet apparatus or a half-tone ink jet apparatus and a recovery device for the ink jet apparatus which can prevent deterioration of the tone on a recording member.

It is another object of the present invention to provide an ink jet apparatus and a recovery device for an ink jet apparatus which reduce cost by minimizing the number of parts of the apparatus.

It is another object of the present invention to provide an ink jet apparatus and a recovery device for an ink jet apparatus which further the trend toward miniaturization of the apparatus.

According to one aspect of the present invention, a recovery device for use with an ink jet apparatus having discharge openings for respectively discharging yellow ink, cyan ink, magenta ink and black ink, comprises a capping member for capping all of the discharge openings collectively, the capping member having a suction opening disposed in the capping member at a location that during capping is proximate to the discharge opening for discharging the black ink, and suction means for applying suction to the suction opening to draw ink from the discharge openings.

According to another aspect of the present invention, a recovery device for use with an ink jet apparatus having discharge openings for respectively discharging yellow ink, cyan ink, magenta ink and black ink, comprises a capping member for capping all of the discharge openings collectively, the capping member having a suction opening disposed in the capping member at a location that during capping is displaced from the discharge opening for discharging the yellow ink, and suction means for applying suction to the suction opening to draw ink from the discharge openings.

According to a still further aspect of the present invention, a recovery device for use with an ink jet apparatus having a first discharge opening for discharging a first ink and a second discharge opening for discharging a second ink darker than the first ink, comprises a capping member for capping the first and the second discharge openings collectively, the capping member having a suction opening disposed in the capping member at a location that during capping is proximate to the discharge opening for discharging the second ink, and suction means for applying suction to the suction opening to draw ink from the discharge openings.

Other objects, features and advantages of the present invention will become apparent from the following detailed description of the preferred embodiments of the present invention and the accompanying drawings.

DESCRIPTION OF THE PREFERRED EMBODIMENTS

Figure 1:
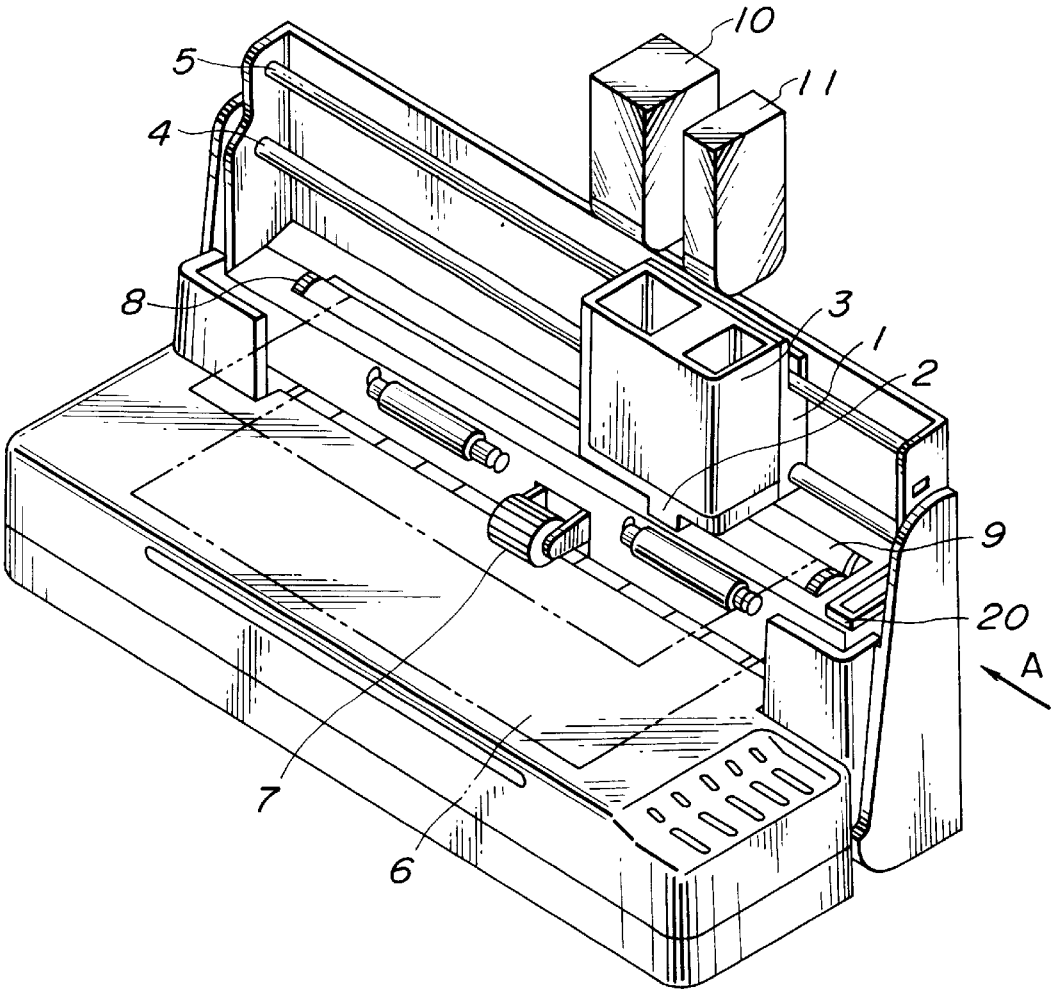
FIG. 1 is a schematic perspective view showing a main portion of a color ink jet recording apparatus for explaining one embodiment of the present invention.

In consideration of the aforesaid technical background, the flow of color ink in a cap can be utilized to reduce mixture of different inks to a minimum and also to overcome the aforesaid problems.

According to the present invention, darker ink flows from discharge openings of the darker ink to a suction opening in the cap as if to avoid discharge openings of lighter ink because the suction opening is located near the discharge openings of the darker ink. Therefore, the discharge openings of the lighter ink are not influenced by the darker ink. Consequently, incorporating the present invention in a color ink jet apparatus or a half-tone (gray-scale) ink jet apparatus can prevent deterioration of recording quality, reduce variations in tone on a recording member to a minimum, and use the simpler structure, mechanism and control system of a single cap.

For example, since yellow ink has such a light color, it is preferable to arrange discharge openings of the yellow ink so they are displaced from the suction opening in the cap during capping.

Those skilled in this art will understand the term the "lightness" of an ink, and the correponding terms "light" and "dark" inks are based on JIS (Japanese Industrial Standard) Z 8105. In the present invention, inks of plural lightness include both different color inks and half-tone (gray-scale) inks, which can be the same color.

In the present invention, it is preferable that a porous ink absorber be provided in the cap. This is because the flow of color ink in the cap becomes more stable by being absorbed in the absorber.

Whether an absorber is provided in the cap or not, it is preferable that any vacant space in the cap be as small as possible. This is because it is easier to control the flow of color ink in the cap if the vacant space is kept small. However, it is also preferable that some vacant space exist in the cap. This is because extraneous matter such as dust or the like easily adheres on a surface of the discharge openings if there is no vacant space in the cap. From this viewpoint, it is preferable that the distance between an inner surface of the cap (a surface of the absorber if it is provided in the cap) and the ink jet head surface with discharge openings be more than 0 mm and not more than 2.0 mm, more suitably not more than 1.0 mm, and most suitably not more than 0.6 mm.

If an absorber that is expandable after absorbing ink is provided in the cap, the aforesaid distance ranges in the cap refer to values after absorbing ink. The lower limit value of such distance in the cap before expanding of the absorber should be more than 0.2 mm.

Referring to the drawings, preferred embodiments of the present invention will be described in detail.

FIG. 1 is a schematic perspective view showing a main portion of a color ink jet recording apparatus for explaining one embodiment of the present invention. As illustrated in FIG. 1, an ink jet recording head 2 and a cartridge guide 3 are carried on a carriage 1 guided by guide rails 4, 5 to move along the guide rails 4, 5 (the drive source is not illustrated in FIG. 1). A recording member 6 such as paper, a plastic sheet, textile or the like is fed into the recording area in the apparatus by a feeding roller 7 and is conveyed between a platen roller (a conveying roller) 8 and a pinch roller, and then between the platen roller 8 and a press plate 9 to the front of the recording head 2 (the pinch roller is not illustrated in FIG. 1). Recording is performed by discharging ink downward from discharge openings on the bottom surface of the recording head 2.

A home position (HP) of the carriage 1 is provided in a range of the movement of the carriage 1 and out of the recording area. A capping member with a cap 20 made of elastic material such as rubber is provided in the home position to cap and seal the discharge openings by being in pressure contact with a surface of the discharge openings of the recording head 2. A recovery apparatus including the capping member is provided usually in the home position to maintain or recover good condition of the discharge openings. This recovery apparatus includes a suction pump for sucking ink and foreign objects such as bubbles, viscous ink and dust from the discharge openings by applying negative pressure to the discharge openings through the capping member while the capping member is capping the discharge openings.

In this embodiment, a three-color ink cartridge 10 storing yellow ink, magenta ink and cyan ink and a black ink cartridge 11 storing black ink are respectively inserted into the cartridge guide 3 to communicate with the respective discharge openings of the recording head 2.

Figure 4:
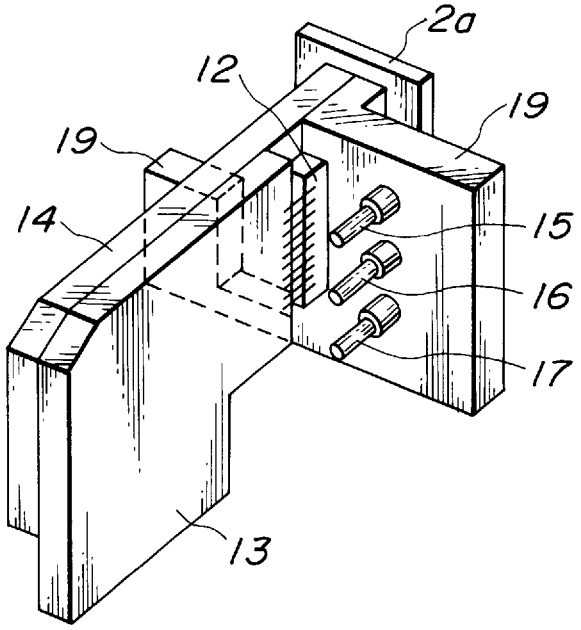
FIG. 4 is a schematic perspective view showing a back side of the ink jet recording head for explaining this embodiment.
Figure 5:
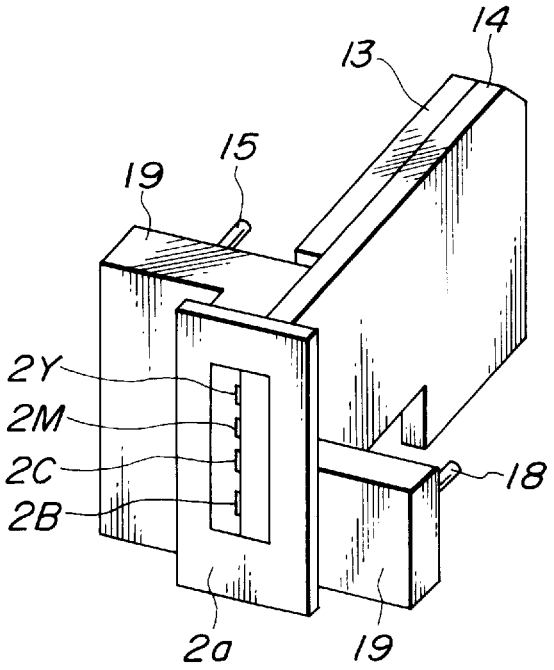
FIG. 5 is a schematic perspective view showing a front side of the ink jet recording head for explaining this embodiment.

FIG. 4 is a schematic perspective view showing a back side of the ink jet recording head for explaining this embodiment. FIG. 5 is a schematic perspective view showing a front side of the ink jet recording head for explaining this embodiment. The discharge openings 2Y for discharging yellow ink, the discharge openings 2M for discharging magenta ink, the discharge openings 2C for discharging cyan ink and the discharge openings 2B for discharging black ink are provided on a straight line on the front surface of the recording head. A front plate **2*a* is provided at the front of the recording head. The discharge openings are located in an opening of the front plate 2*a***.

Respective discharge openings are communicated with ink paths communicated with corresponding common ink chambers to the color of ink. Reference numeral 19 designates a distributor made of plastics containing the common ink chambers to distribute ink from the common ink chambers to the ink paths.

Energy generating bodies 2H (FIG. 2) such as electrothermal converting bodies for generating energy utilized to discharge ink from the discharge openings and wirings for supplying electric power to the energy generating bodies are provided along the ink paths. The energy generating bodies and the wiring are formed as films on a substrate 12 made of silicon or the like. The discharge openings, the ink paths and the common ink chambers are formed by accumulating a wall member, a top plate or the like made of resin, glass or the like on the substrate 12. Reference numeral 13 designates a printed circuit board with a driving circuit for driving the energy generating bodies according to recording signals. The substrate 12 and the printed circuit board 13 are fixed on a common base plate 14 made of aluminum or the like.

The ink cartridges are inserted substantially parallel to the base plate 14 and are connected to a pipe 15 for yellow ink, a pipe 16 for magenta ink, a pipe 17 for cyan ink and a pipe 18 for black ink. The pipes 15 to 18 are protruded substantially parallel to the base plate 14 from a distributor 19, which is extended perpendicularly to the substrate 12, and are communicated with the common ink chambers respectively.

Figure 2:
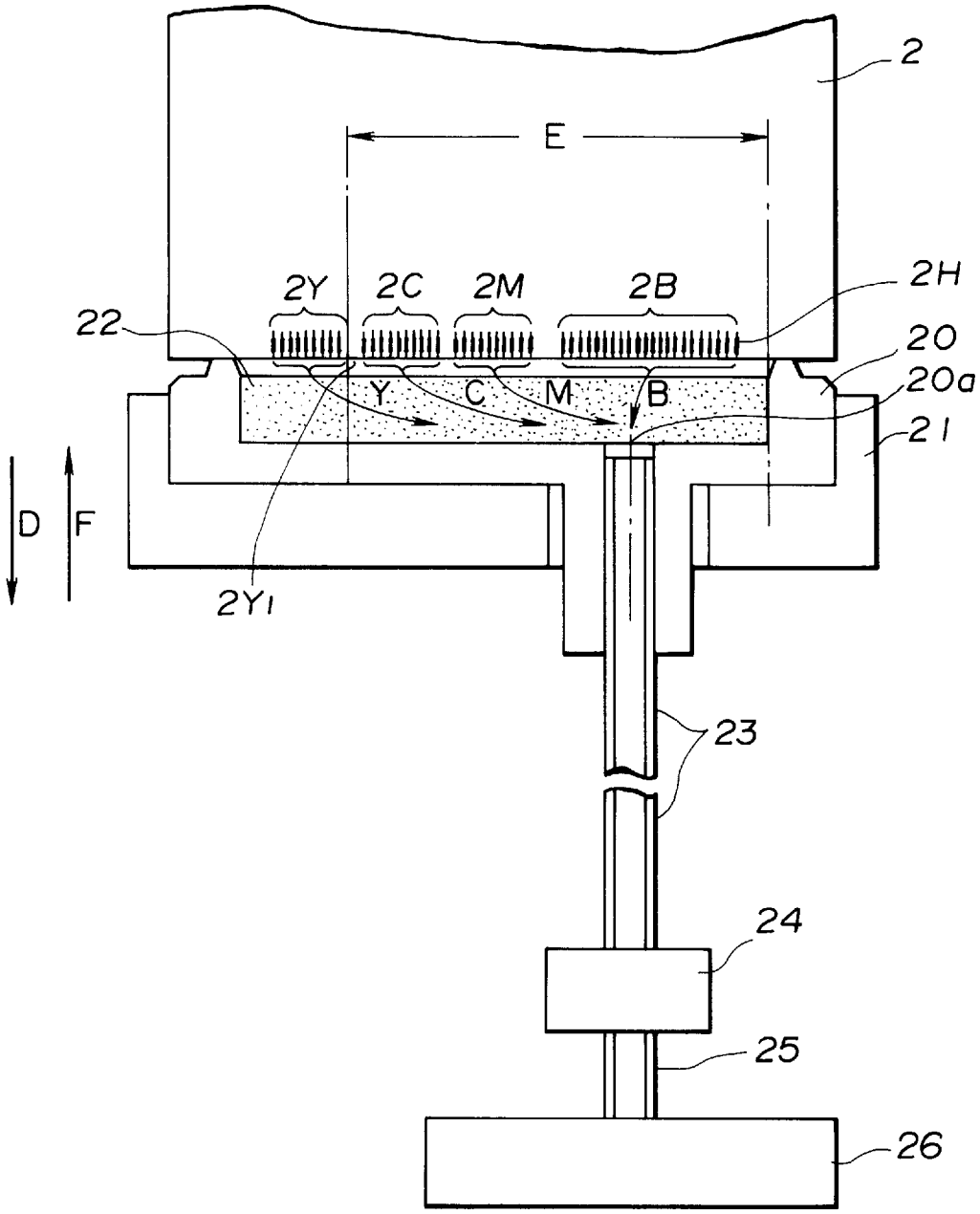
FIG. 2 is a schematic sectional view, showing an ink jet recovery mechanism of this embodiment, taken in the direction of the arrow A in FIG. 1.
Figure 3:
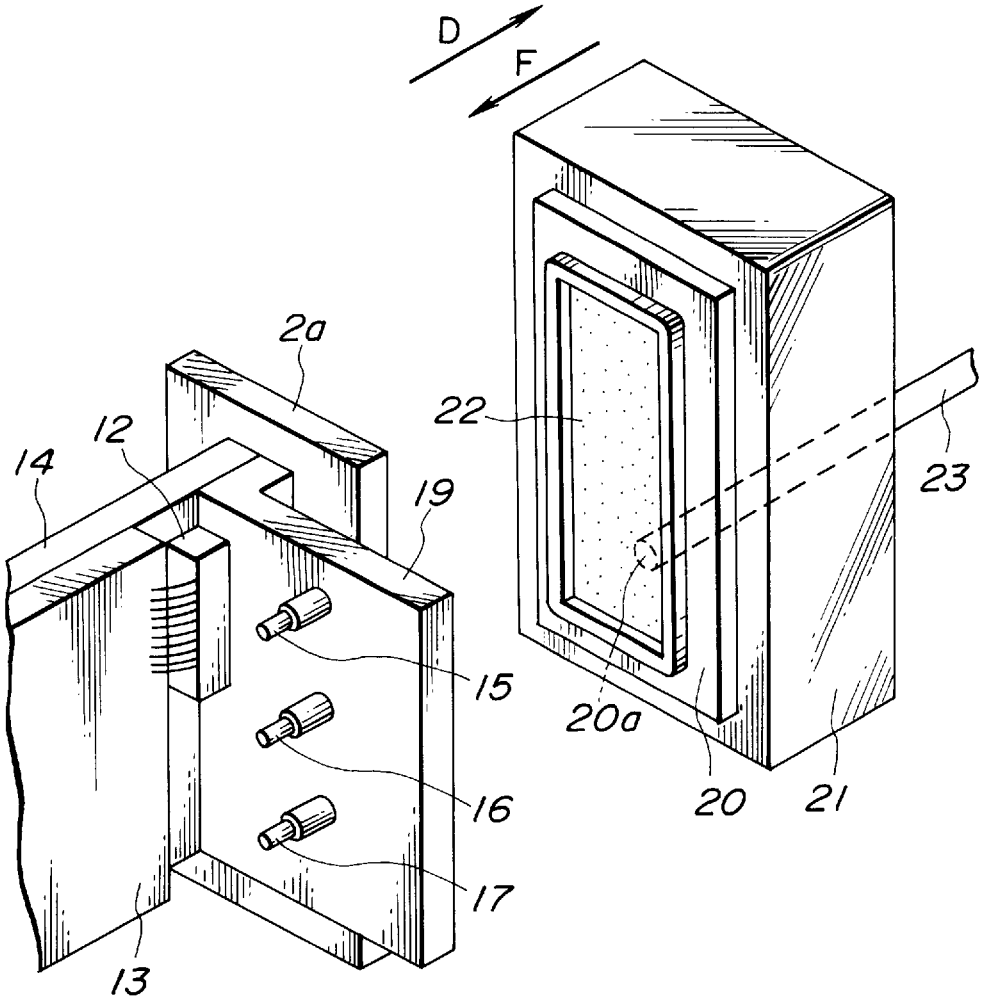
FIG. 3 is a schematic perspective view showing an ink jet capping mechanism of this embodiment.

FIG. 2 is a schematic sectional view showing an ink jet recovery mechanism of this embodiment in the direction of the arrow A in FIG. 1. FIG. 3 is a schematic perspective view showing an ink jet capping mechanism of this embodiment. When poor discharging such as clogging of the discharge openings occurs, the carriage 1 moves to the home position and stops there. The cap 20 fixed to a cap holder 21 moves in the direction of the arrow F to cap the discharge openings. Reference characters 2Y, 2C, 2M and 2B designate respectively discharge openings of yellow, cyan, magenta and black. The number of the discharge openings 2B is 128, and those of the other discharge openings 2Y, 2C and 2M are respectively 64. These discharge openings are capped collectively by the cap 20. An ink absorber 22 (SPONGE BELL-EATER made by KANEBO CO.) is provided in the cap 20.

One end of a tube 23 is connected to the back side of the cap 20 (the opposite side of the contact side to the recording head 2) through a suction opening 20*a,* and the other end of the tube 23 is connected to a suction pump 24. The suction pump 24 is connected to a waste ink storing portion 26 through a tube 25. Ink in the recording head 2 is sucked from the discharge openings by a negative pressure generated by the suction pump 24 during capping by the cap 20. This sucked waste ink flows to the waste ink storing portion 26 through the suction opening 20*a,* the tube 23, the suction pump 24 and the tube 25. After suction recovery, the cap holder 21 moves in the direction of the arrow D to release the cap 20 from the recording head 2.

During capping, the suction opening 20*a* is located in the cap 20 nearest to the discharge openings 2B of black ink, the darkest ink, that is to say, farthest from the discharge openings 2Y of yellow ink, the lightest ink. During suction recovery, sucked black ink flows substantially from the discharge openings 2B to the suction opening 20*a* through the ink absorber 22 in the direction of the arrow B without passing near the other discharge openings. Sucked magenta ink (the second darkest ink in this embodiment) flows substantially from the discharge openings 2M to the suction opening 20*a* through the ink absorber 22 in the direction of the arrow M without passing near the discharge openings 2C and 2Y. Sucked cyan ink (the second lightest ink in this embodiment) flows substantially from the discharge openings 2C to the suction opening 20*a* through the ink absorber 22 in the direction of the arrow C without passing near the discharge openings 2Y. Sucked yellow ink flows substantially from the discharge openings 2Y to the suction opening 20*a* through the ink absorber 22 in the direction of the arrow Y.

In this embodiment, black ink from the discharge openings 2B mixes with the other color ink only near the discharge openings 2B in the cap 20. Magenta ink from the discharge openings 2M mixes with black ink only near the discharge openings 2B in the cap 20, and mixes with cyan ink and yellow ink only near the discharge openings 2M and 2B in the cap 20. Cyan ink from the discharge openings 2C mixes with black ink only near the discharge openings 2B in the cap 20, mixes with magenta ink only near the discharge openings 2M and 2B in the cap 20, and mixes with yellow ink only near the discharge openings 2C, 2M and 2B. Yellow ink from the discharge openings 2Y 1 mixes with black ink only near the discharge openings 2B in the cap 20, mixes with magenta ink only near the discharge openings 2M and 2B in the cap 20, and mixes with cyan ink only near the discharge openings 2C, 2M and 2B.

According to this embodiment, the lighter the color of the ink, the less it mixes with the other color ink near the discharge openings of the ink in the cap. Generally, the darker the color of ink, the less influence it receives from the other color inks. Therefore, according to this embodiment, even though the cap covers all of the discharge openings of the various color inks collectively, in order to provide a simple structure and a simple control system, influence by mixture of various color inks in the cap can be reduced to a minimum.

It is best to locate the suction opening at the aforesaid position, that is, nearest to the discharge openings of black ink in the cap. In this type of ink jet apparatus wherein the number of discharge openings of black ink is greater than the number of discharge openings of any other color ink, this location of the suction opening is preferable. This is because more waste black ink flows out from the relatively greater number of discharge openings 2B that it would otherwise have a large influence over the other color inks.

However, the present invention can include other arrangements in which the suction opening is located anywhere in the range E in FIG. 2, that is, displaced from the discharge openings 2Y. The range E is from the edge of the first discharge opening 2Y 1 (toward the discharge openings 2B) to the edge of the cap 20 at the side thereof proximate to the discharge openings 2B. It is not advisable to have the suction opening at a location where the waste ink will contact the yellow ink discharge openings 2Y, since yellow ink is so easily influenced by any of the other color inks.

Figure 6:
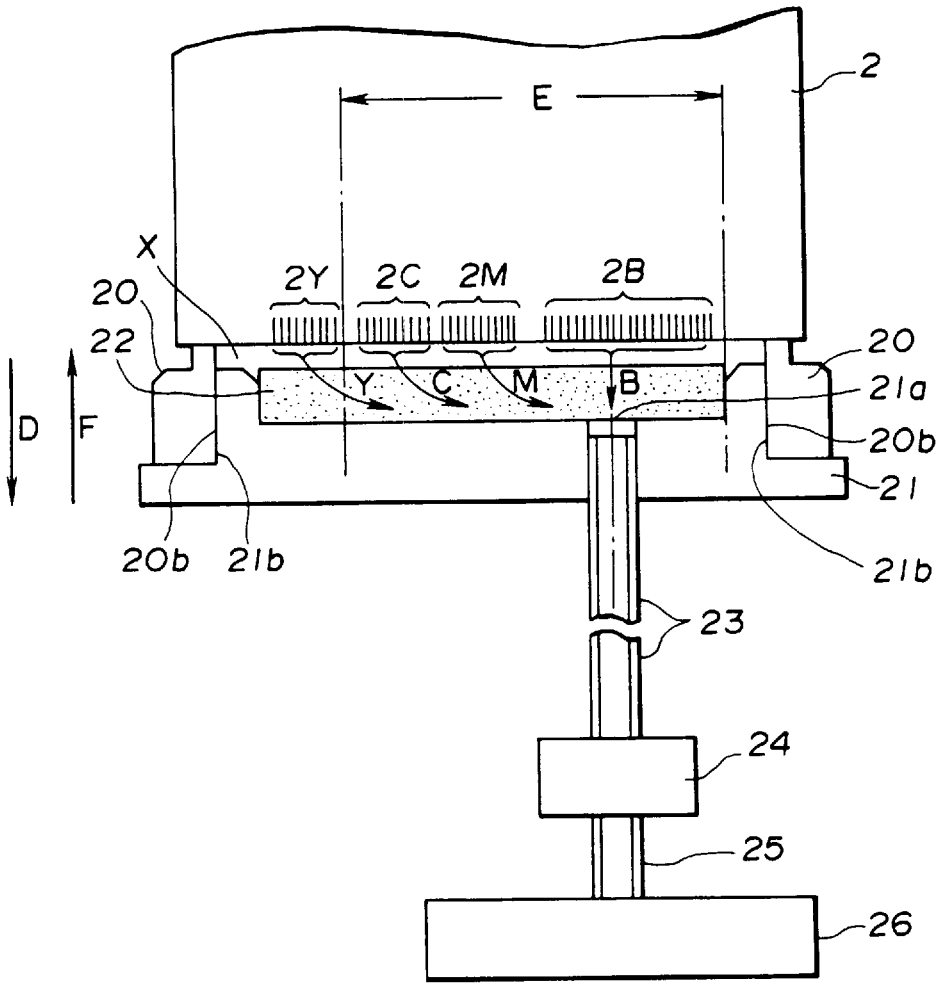
FIG. 6 is a schematic sectional plan view showing an ink jet recovery mechanism of another embodiment of the present invention.

FIG. 6 is a schematic sectional plan view showing an ink jet recovery mechanism of another embodiment of the present invention. In this embodiment, shapes of a cap 20 and a cap holder 21 are different from the aforesaid first embodiment. An inner side 20*b* of the cap 20 made of elastic material is fixed under pressure in an outer side 21*b* of the cap holder 21. The discharge openings are sealed in a vacant space X by both the cap 20 and the cap holder 21. The distance between a surface of the absorber 22 and a surface of the discharge openings may be 3.0 mm in this embodiment. The suction opening 21*a* is provided for the cap holder 21 instead of the cap. It is advantageous to locate the suction opening 21*a* nearest to the discharge openings 2B of black ink in the capping member (the cap and the cap holder). However, the suction opening can be located in the range E in FIG. 6 as in FIG.2. The structure and operation of this embodiment is the same as the aforesaid first embodiment.

Figure 7:
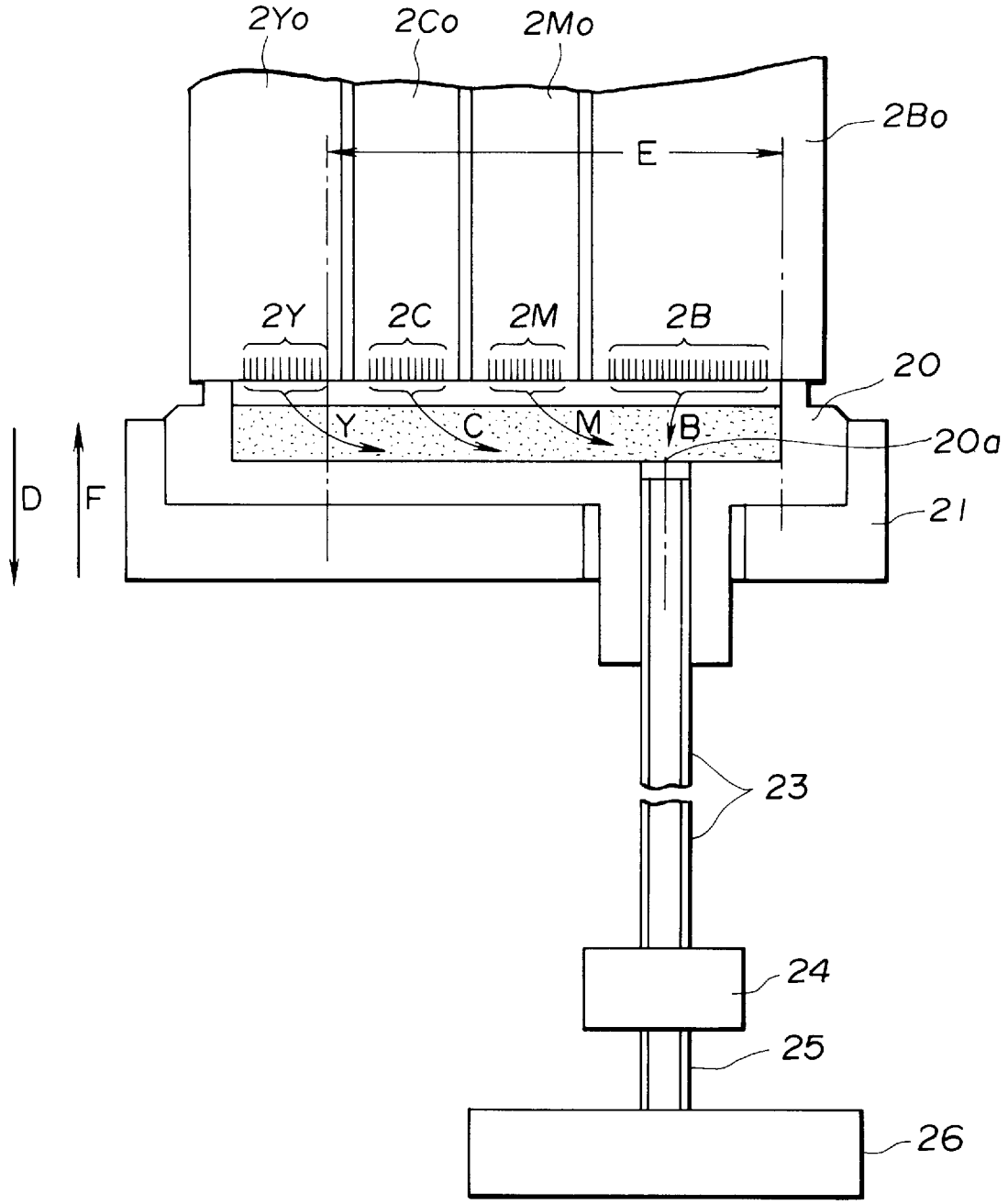
FIG. 7 is a schematic sectional plan view showing an ink jet recovery mechanism of another embodiment of the present invention.

FIG. 7 is a schematic sectional plan view showing an ink jet recovery mechanism of another embodiment of the present invention. In this embodiment, the structure of the ink jet recording head is different from the aforesaid first embodiment. This color ink jet recording head is formed by unifying four independent heads, head 2Y 0 being an independent head for yellow ink, head 2C 0 being an independent head for cyan ink, head 2M 0 being an independent head for magenta ink, and head 2B 0 being an independent head for black ink. As before, it is preferable to locate the suction opening 21*a* nearest to the discharge openings 2B of black ink in the cap, although the suction opening can be located in the range E as well. The structure and operation of this embodiment is the same as the aforesaid embodiments in aspects not specially described here.

Figure 8:
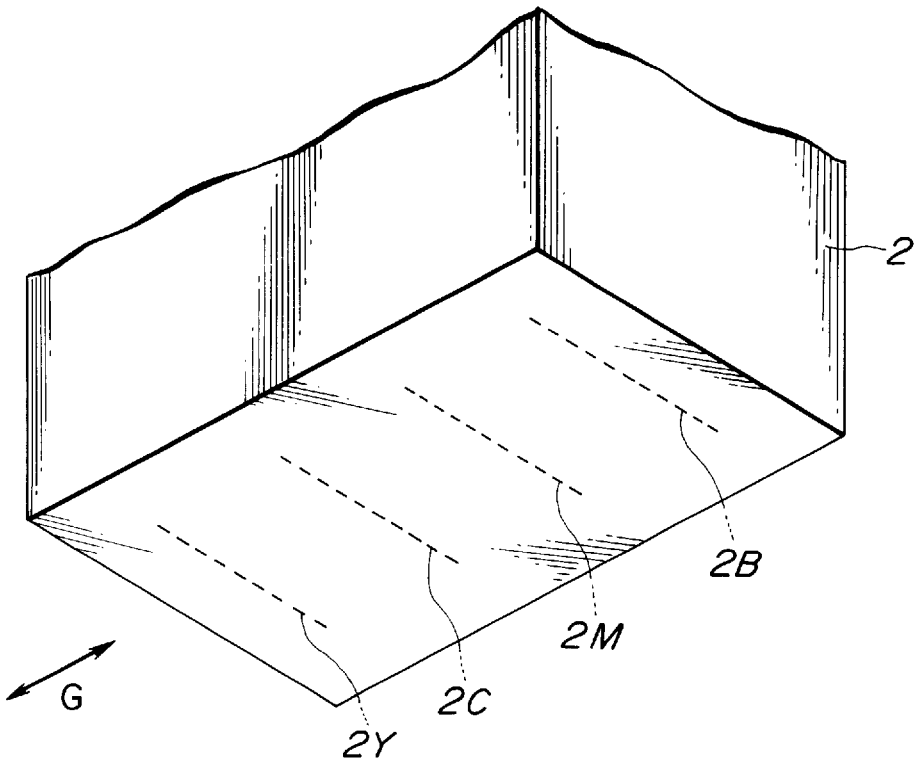
FIG. 8 is a schematic perspective view showing an ink jet recording head of another embodiment of the present invention.
Figure 9:
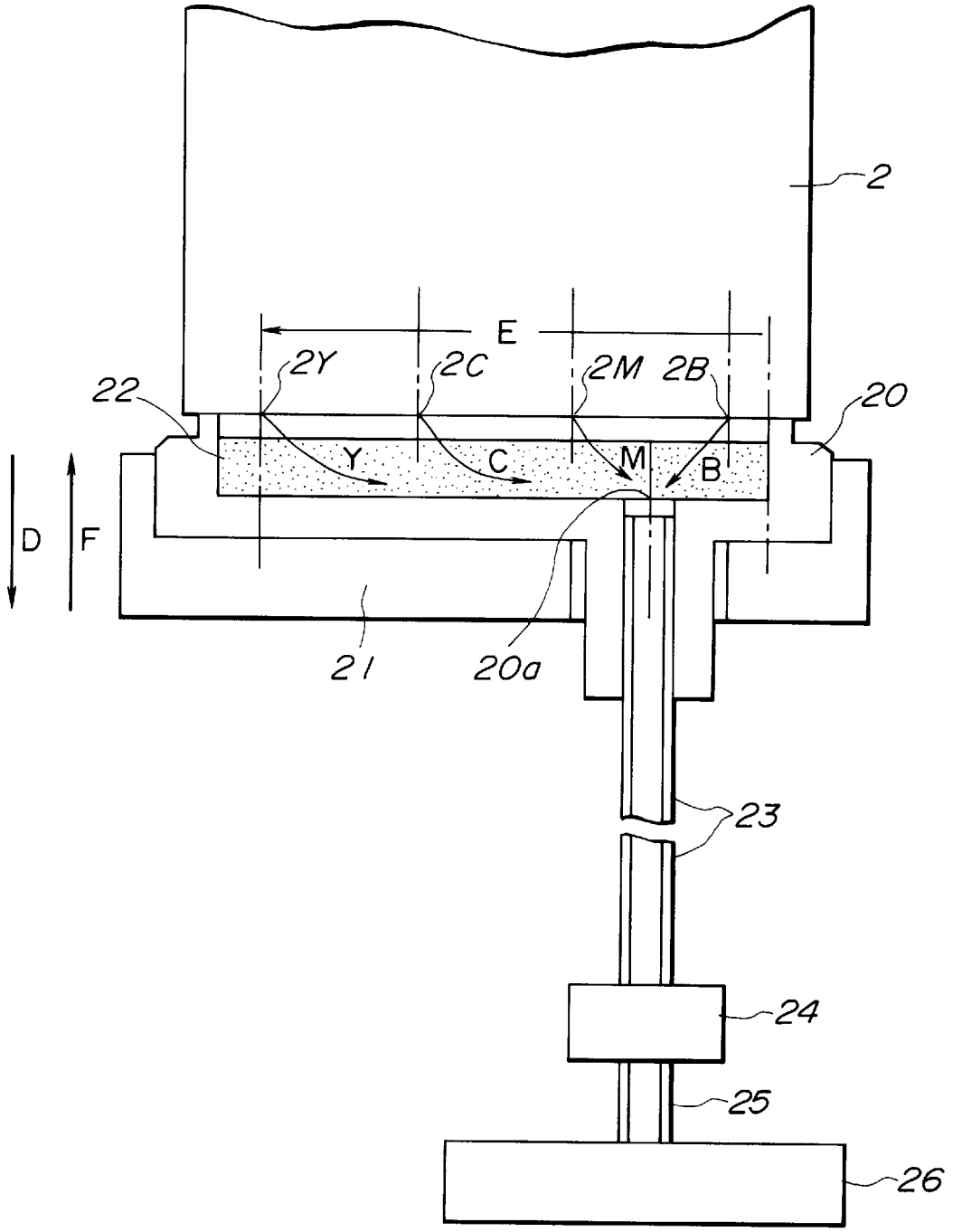
FIG. 9 is a schematic sectional view showing an ink jet recovery mechanism of this embodiment.

FIG. 8 is a schematic perspective view showing an ink jet recording head of another embodiment of the present invention. FIG. 9 is a schematic sectional plan view showing an ink jet recovery mechanism of this embodiment. The arrow G indicates the directions of movement of the recording head 2 on the carriage 1 in the apparatus. The discharge openings of color ink are arranged in four rows substantially perpendicular to the direction G in this embodiment, while the discharge openings of color ink are arranged in one line in the aforesaid embodiments. Again, it is preferable to locate the suction opening 21*a* nearest to the discharge openings 2B of black ink in the cap, although the suction opening can be located in the range E shown in FIG. 9. The range E is from the discharge openings 2Y to the edge of the cap 20 at the side thereof proximate to the discharge openings 2B. The structure and operation of this embodiment is otherwise the same as in the aforesaid embodiments.

Figure 10:
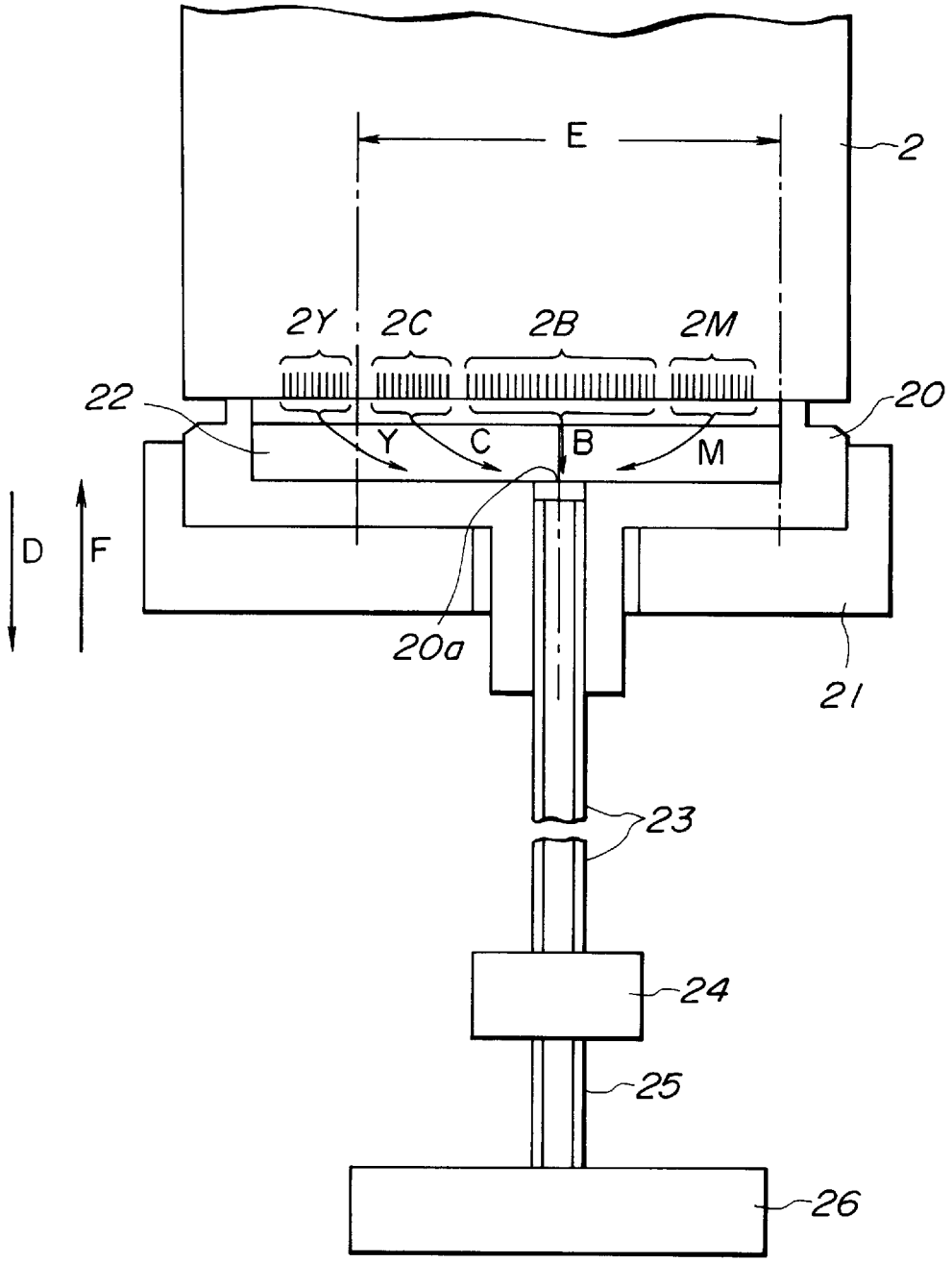
FIG. 10 is a schematic sectional plan view showing an ink jet recovery mechanism of another embodiment of the present invention.

FIG. 10 is a schematic sectional plan view showing an ink jet recovery mechanism of still another embodiment of the present invention. In this embodiment, the order of the discharge openings is different from the first embodiment. The discharge openings 2B of black ink are located between the discharge openings 2C of cyan ink and the discharge openings 2M of magenta ink in this embodiment. It is still preferable to locate the suction opening 20*a* nearest to the discharge openings 2B of black ink in the cap, although the suction opening can be located in the range E shown in FIG. 10. The structure and operation of this embodiment is otherwise the same as the aforesaid embodiments.

The present invention is particularly useful in an ink jet recording apparatus in which ink is discharged by utilizing thermal energy, as shown in U.S. Pat. Nos. 4,723,129 and 4,740,796 for example. In this type of ink jet recording apparatus, a driving signal is supplied to generate such a quick temperature rise beyond nucleation boiling point on a heating portion of an ink jet head that a bubble by film boiling is generated in ink and ink is discharged through a discharge opening to produce at least one droplet. The driving signal is preferably in a form of a pulse because development and collapse of the bubble can be effected instantaneously and ink is discharged with a quick response. The driving signal in a form of the pulse is preferably such as that disclosed in U.S. Pat. Nos. 4,463,359 and 4,345,262. In addition, the temperature increasing rate of the heating surface is preferably such as that disclosed in U.S. Pat. No. 4,313,124. The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents.

In addition, the present invention is applicable to the structure disclosed in Japanese Patent Laid-Open (Kokai) No. 59-123670 wherein a common slit is used as the ejection outlet for plural electrothermal transducers, and to the structure disclosed in Japanese Patent Laid-Open (Kokai) No. 59-138461 wherein an opening for absorbing a pressure wave of the thermal energy is formed corresponding to the ejecting portion. This is because the present invention is effective to perform the recording operation with certainty and at high efficiency irrespective of the type of the recording head. The present invention is effectively applicable to a so-called full-line type recording head having a length corresponding to the maximum recording width. Such a recording head may comprise a single recording head or plural recording heads combined to cover the entire width. In addition, the present invention is applicable to a serial type recording head wherein the recording head is fixed on the main assembly, to a replaceable-chip type recording head which is connected electrically with the main apparatus and can be supplied with the ink by being mounted in the main assembly, or to a cartridge type recording head having an integral ink container.

The provision of recovery means and auxiliary means for preliminary operation are preferable, because they can further stabilize the effect of the present invention. As for such means, there are cleaning means, pressing means, preliminary heating means by the electrothermal transducer or by a combination of the electrothermal transducer and an additional heating element and means for preliminary ejection not for the recording operation, which can stabilize the recording operation.

Figure 11:
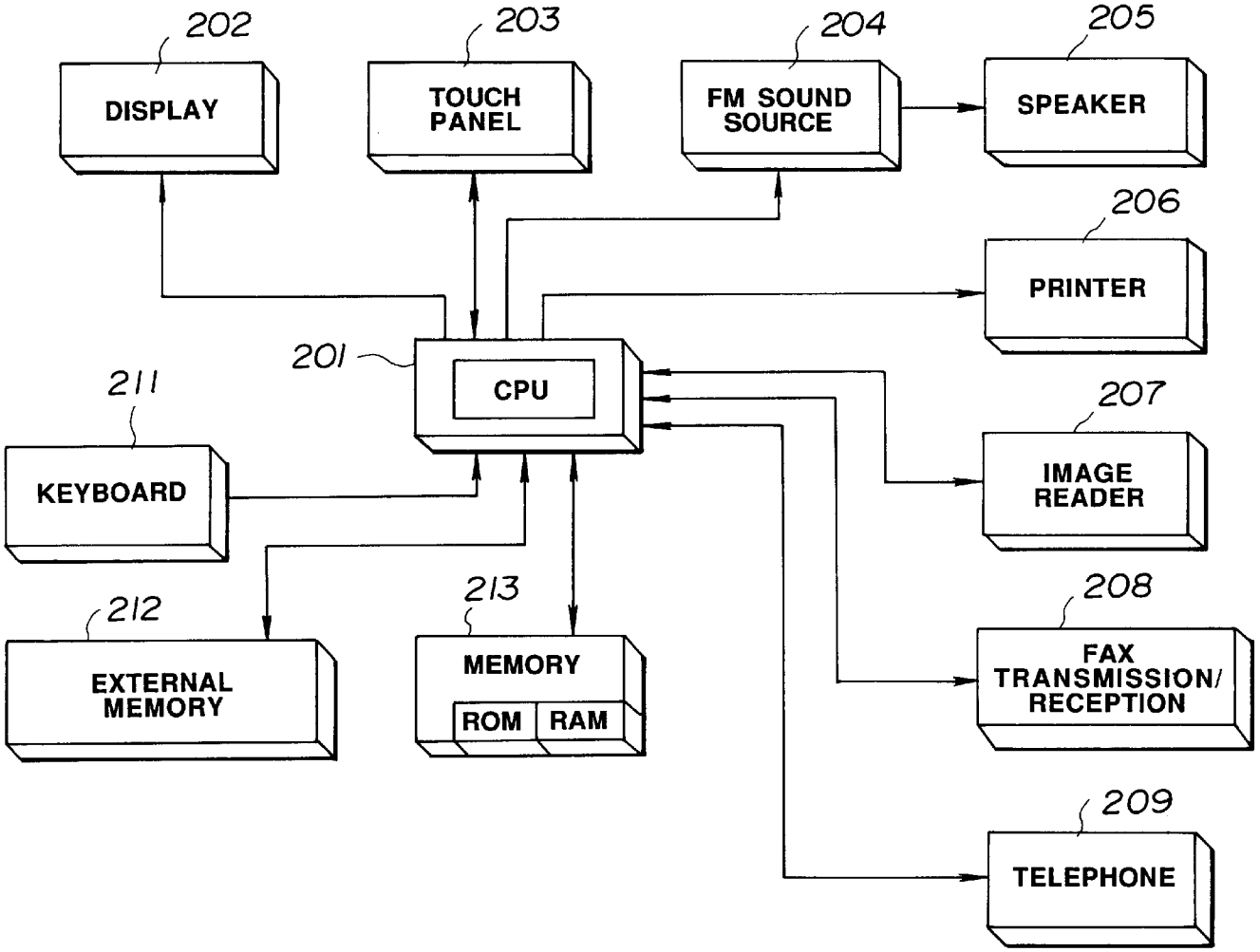
FIG. 11 is a block diagram of an information processor usable with the present invention.

The ink jet recording apparatus may be used as an output terminal of an information processing apparatus such as computer or the like, a copying apparatus combined with an image reader or the like, or a facsimile machine having information sending and receiving functions. FIG. 11 is a block diagram schematically illustrating the construction of an information processor, having the functions of a word processor, a personal computer, a facsimile machine and a copying machine, to which the recording apparatus of the present invention can be applied. A control unit 201 has overall control of the information processor, and has a CPU constituted of a microprocessor or the like, and various I/O ports. The control unit 201 controls other components by outputting control signals, data signals and the like to the other components and receiving controls signals and data signals therefrom. A display unit 202 has a display screen on which various menus, document information and image data read with an image reader 207 are displayed. 203 is a transparent pressure-sensitive touch panel provided over the display unit 202. Data item inputting and coordinate position inputting through the display unit 202 can be performed by pressing a surface of the touch panel 203 with a finger or the like. Music information prepared with a music editor is stored as digital data in a memory 213 or an external memory 212 and is read therefrom to be FM-modulated by a frequency moduration (FM) sound source 204. An electrical signal from the FM sound source 204 is converted into an audible sound by a speaker 205. A printer unit 206 is an output terminal in accordance with the present invention. An image reader unit 207 includes means for photoelectrically reading an original and inputting read original data. The image reader unit 207 is provided at an intermediate portion of an original transport path. The image reader unit 207 reads facsimile originals, originals to be copied and other various kinds of originals. A facsimile transmission/reception unit 208 serves for facsimile transmission of original data read by the image reader unit 207 and which receives a transmitted facsimile signal and decodes the receives signal. Facsimile transmission/reception unit 208 functions as an interface with an external terminal. A telephone unit 209 has various telephone functions such as an ordinary telephone function and a message recording function. A memory unit 210 includes a ROM for storing a system program, a manager program, application programs, character fonts, dictionaries, and other categories of data, and a RAM for storing application programs, character information, video data and other categories of data loaded from the external memory 212. A keyboard unit 211 is provided for inputting document information and various kinds of commands. An external memory unit 212 uses a floppy disk, hard disk or the like as a memory medium. Character information, music or sound information, user's application programs, and the like are stored in the external memory unit 212.

Figure 12:
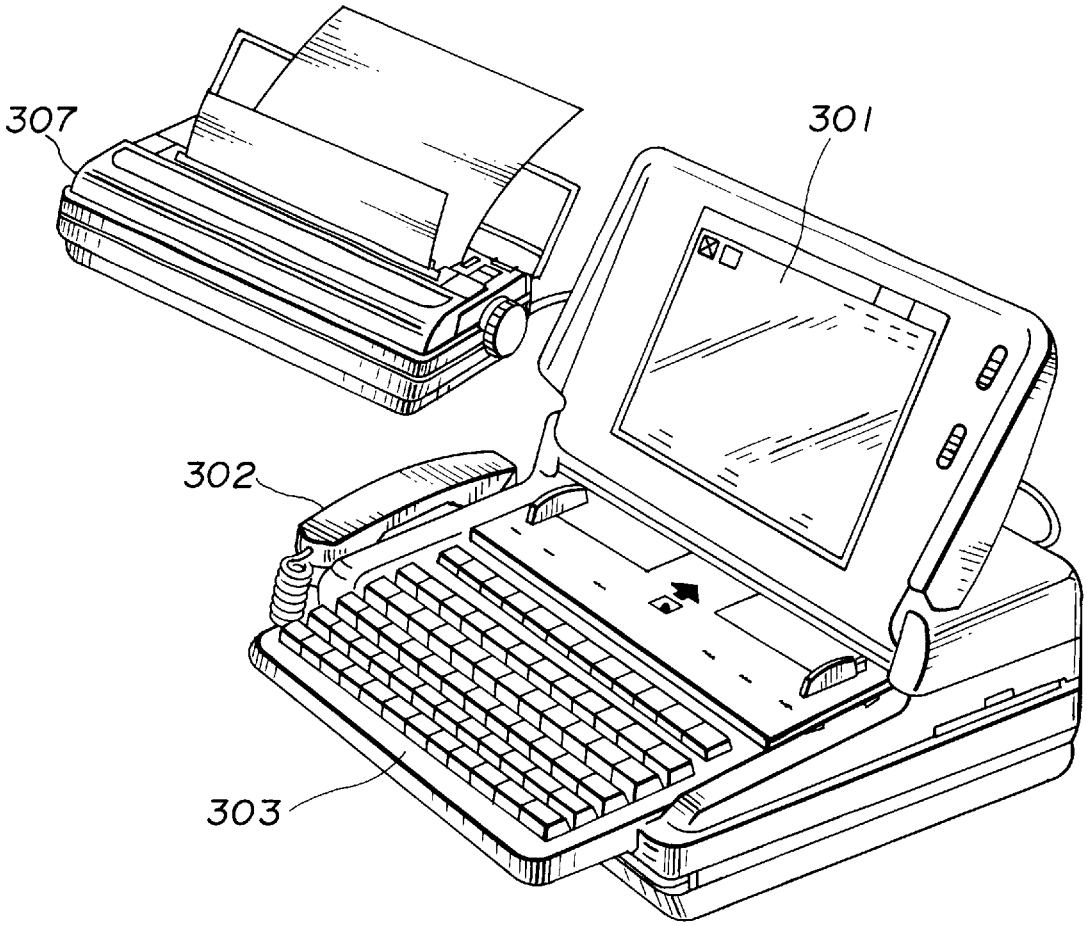
FIG. 12 is a perspective view showing one information processor usable with the present invention.

FIG. 12 is a schematic perspective view showing the information processor shown in block form in FIG. 11. On a flat display panel 301 using a liquid crystal or the like, various menus, drawing information, document information and other categories of information are displayed. The touch panel is placed on the display panel 301. Coordinate inputting and item designation inputting can be performed by pressing the surface of the touch panel. A handset 302 is used when the information processor functions as a telephone. The keyboard 303 is detachably connected to the main body and is capable of inputting various kinds of character information and various processor. At the time of facsimile reception, received information is recorded by an ink jet printer 307 in accordance with the present invention. The display 301 may be a CRT. However, a flat panel display such as a liquid crystal display utilizing a ferroelectric liquid crystal is particularly preferred as display 301, because it can be reduced in size, thickness and weight. When the information process functions as a personal computer or a word processor, various information items input through the keyboard unit 211 as shown in FIG. 11 are processed by the control unit 201 in accordance with a predetermined program to be output as an image through the printer 206. When the information processor functions as a receiver of a facsimile machine, facsimile information input through the facsimile transmission/reception unit 208 is received and processed by the control 201 in accordance with a predetermined program to be transmitted through a communication line by the facsimile transmission/reception unit 208.

Figure 13:
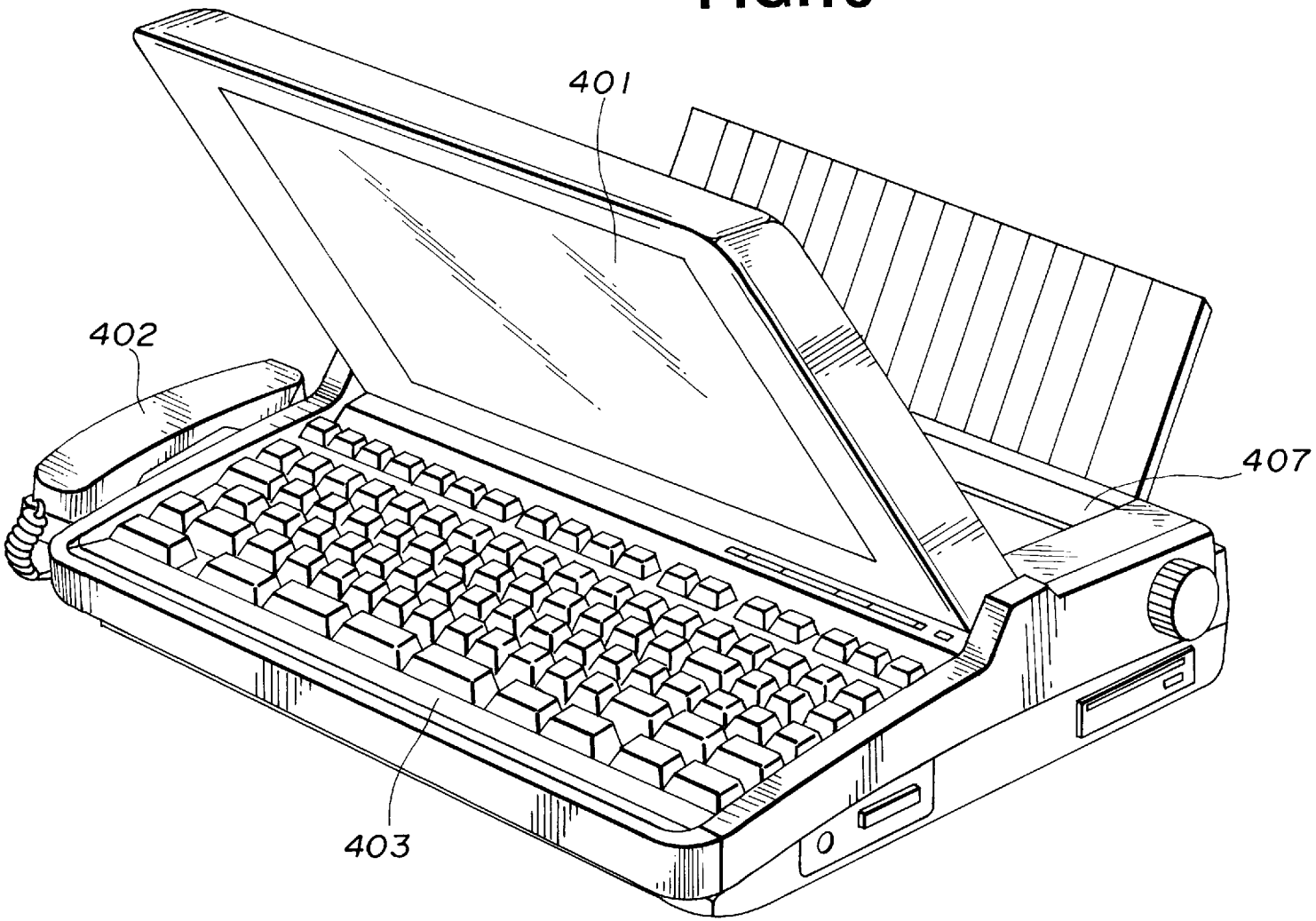
FIG. 13 is a perspective view showing another information processor usable with the present invention.

The above-described information processor may be constructed as one integral unit having an ink jet printer in the main body as shown in FIG. 13. In this case, its portability is improved. In FIG. 13, components having the same functions are identified by reference numerals in the 400s, with components corresponding to those shown in FIG. 12 being indicated by reference numerals which have the same last two digits. By the application of the recording apparatus of the present invention to the above-described multifunction type information processor, a high-quality recorded image can be obtained and the functions of the information processor can be improved.

While the present invention has been described with respect to what is currently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet apparatus comprising:

discharge openings for respectively discharging yellow ink, cyan ink, magenta ink and black ink;

a capping member having a common capping chamber formed therein for capping all of said discharge openings collectively, said capping member having a suction opening disposed in said capping member at a location that during capping is closer to those of said discharge openings for discharging the black ink than to said discharge openings for the yellow ink, the cyan ink and the magenta ink; and suction means for applying suction to said suction opening to draw ink from said discharge openings.

2. An ink jet apparatus according to claim 1, wherein there are a greater number of said discharge openings for discharging the black ink than there are for each of the yellow ink, the cyan ink and the magenta ink.

3. An ink jet apparatus according to claim 1, further comprising a single ink jet head including all of said discharge openings for the yellow ink, the cyan ink, the magenta ink and the black ink.

4. An ink jet apparatus according to claim 1, further comprising independent ink jet heads, each including said discharge openings for one of the yellow ink, the cyan ink, the magenta ink and the black ink.

5. An ink jet apparatus according to claim 1, wherein said discharge openings are arranged in a single direction.

6. An ink jet apparatus according to claim 5, wherein said discharge openings are arranged in a line in said direction.

7. An ink jet apparatus according to claim 1, wherein said discharge openings for each of the yellow ink, the cyan ink, the magenta ink and the black ink are arranged in separate rows.

8. An ink jet apparatus according to claim 1, having a discharge opening surface with said discharge openings for the yellow ink, the cyan ink, the magenta ink and the black ink disposed in that order along said surface.

9. An ink jet apparatus according to claim 1, wherein the inks are discharged from said discharge openings by utilizing thermal energy.

10. An ink jet apparatus comprising:

discharge openings for respectively discharging yellow ink, cyan ink, magenta ink and black ink;

a capping member having a common capping chamber formed therein for capping all of said discharge openings collectively, said capping member having a suction opening disposed in said capping member at a location that during capping is more remote from those of said discharge openings for discharging the yellow ink than from said discharge openings for the cyan ink, the magenta ink and the black ink; and suction means for applying suction to said suction opening to draw ink from said discharge openings.

11. An ink jet apparatus according to claim 10, wherein there are a greater number of said discharge openings for discharging the black ink than there are for each of the yellow ink, the cyan ink and the magenta ink.

12. An ink jet apparatus according to claim 10, further comprising a single ink jet head including all of said discharge openings for the yellow ink, the cyan ink, the magenta ink and the black ink.

13. An ink jet apparatus according to claim 10, further comprising independent ink jet heads, each including said discharge openings for one of the yellow ink, the cyan ink, the magenta ink and the black ink.

14. An ink jet apparatus according to claim 10, wherein said discharge openings are arranged in a single direction.

15. An ink jet apparatus according to claim 14, wherein said discharge openings are arranged in a line in said direction.

16. An ink jet apparatus according to claim 10, wherein said discharge openings for each of the yellow ink, the cyan ink, the magenta ink and the black ink are arranged in separate rows.

17. An ink jet apparatus according to claim 10, having a discharge opening surface with said discharge openings for the yellow ink, the cyan ink, the magenta ink and the black ink disposed in that order along said surface.

18. An ink jet apparatus according to claim 10, wherein the inks are discharged from said discharge openings by utilizing thermal energy.

19. An ink jet apparatus comprising:

a first discharge opening for discharging first ink and a second discharge opening for discharging second ink darker than said first ink;

a capping member having a common capping chamber formed therein for capping said first and said second discharge openings collectively, said capping member having a suction opening disposed in said capping member at a location that during capping is closer to said second discharge opening for discharging the second ink than to said first discharge opening for discharging the first ink; and suction means for applying suction to said suction opening to draw ink from said discharge openings.

20. An ink jet apparatus according to claim 19, wherein an ink absorber is provided in said capping member.

21. An ink jet apparatus according to claim 19 or 20, having a discharge opening surface with said discharge openings, wherein during capping there is a distance between said discharge opening surface and an opposed surface to said discharge opening surface of not more than 2.0 mm.

22. An ink jet apparatus according to claim 21, wherein the distance is not more than 1.0 mm.

23. An ink jet apparatus according to claim 22, wherein the distance is not more than 0.6 mm.

24. An ink jet apparatus according to claim 19, wherein said capping member has an elastic cap and a cap holder holding said elastic cap.

25. An ink jet apparatus according to claim 19, wherein the inks are discharged from said discharge openings by utilizing thermal energy.

26. A recovery device for use with an ink jet apparatus having discharge openings for respectively discharging yellow ink, cyan ink, magenta ink and black ink, said recovery device comprising:

a capping member having a common capping chamber formed therein for capping all of said discharge openings collectively, said capping member having a suction opening disposed in said capping member at a location that during capping is closer to those of said discharge openings for discharging the black ink than to said discharge openings for the yellow ink, the cyan ink and the magenta ink; and suction means for applying suction to said suction opening to draw ink from said discharge openings.

27. A recovery device for use with an ink jet apparatus having discharge openings for respectively discharging yellow ink, cyan ink, magenta ink and black ink, said recovery device comprising:

a capping member having a common capping chamber formed therein for capping all of said discharge openings collectively, said capping member having a suction opening disposed in said capping member at a location that during capping is more remote from those of said discharge openings for discharging the yellow ink than from said discharge openings for the cyan ink, the magenta ink and the black ink; and suction means for applying suction to said suction opening to draw ink from said discharge openings.

28. A recovery device for use with an ink jet apparatus having a first discharge opening for discharging first ink and a second discharge opening for discharging second ink darker than said first ink, said recovery device comprising:

a capping member having a common capping chamber formed therein for capping said first discharge opening and said second discharge opening collectively, said capping member having a suction opening disposed in said capping member at a location that during capping is closer to said second discharge opening for discharging the second ink than to said first discharge opening for discharging the first ink; and suction means for applying suction to said suction opening to draw ink from said discharge openings.

29. A recovery device according to claim 28, wherein an ink absorber is provided in said capping member.

30. A recovery device according to claim 28 or 29, having a discharge opening surface with said discharge openings, wherein during capping there is a distance between said discharge opening surface and an opposed surface to said discharge opening surface of not more than 2.0 mm.

31. A recovery device according to claim 30, wherein the distance is not more than 1.0 mm.

32. A recovery device according to claim 31, wherein the distance is not more than 0.6 mm.

33. A recovery device according to claim 28, wherein said capping member has an elastic cap and a cap holder holding said elastic cap.

* * * * *